US006237390B1

(12) United States Patent
Honsel et al.

(10) Patent No.: US 6,237,390 B1
(45) Date of Patent: May 29, 2001

(54) RIVETING APPARATUS

(75) Inventors: Michael H. Honsel, Froendenberg (DE); Dallas B. Perkins, Seminole, FL (US)

(73) Assignees: M. H. Honsel Beteilgungs GmbH (DE); Sartam Industries, Inc., Venice, FL (US)

( * ) Notice: Subject to any disclaimer, the term of this patent is extended or adjusted under 35 U.S.C. 154(b) by 0 days.

(21) Appl. No.: 09/292,876

(22) Filed: Apr. 16, 1999

(30) Foreign Application Priority Data

Apr. 27, 1998 (DE) ..... 198 18 756

(51) Int. Cl.[7] ..... B21J 15/26
(52) U.S. Cl. ..... 72/449; 72/391.4; 29/243.526
(58) Field of Search ..... 29/243.521, 243.526; 72/391.4, 391.8, 449

(56) References Cited

U.S. PATENT DOCUMENTS 2,753,072 * 7/1956 Mitchell ..... 29/243.526
3,119,507 * 1/1964 Burritt ..... 29/243.526
3,359,777 * 12/1967 Lee ..... 29/243.526
3,410,128 * 11/1968 Sauter et al. ..... 29/243.526
4,085,337 * 4/1978 Moeller ..... 72/391.8
5,131,255 * 7/1992 Fushiya et al. ..... 72/391.8
5,473,805 * 12/1995 Wile ..... 29/243.526

FOREIGN PATENT DOCUMENTS 0527414 5/1995 (EP) .

* cited by examiner

*Primary Examiner*—David Jones
(74) *Attorney, Agent, or Firm*—Coudert Brothers

(57) ABSTRACT

The present invention relates to a riveting apparatus, having an electrically operated drive motor which has a motor shaft for driving a riveting device of the riveting apparatus, the riveting device having a gearing for transferring the rotational movement of the motor shaft into a linear movement of the riveting device having a constant transmission ratio. In order to reduce the power consumption of a riveting apparatus of that kind, the invention provides at least one flywheel which can be connected in a releasable manner with the motor shaft via a coupling.

14 Claims, 3 Drawing Sheets

RIVETING APPARATUS

BACKGROUND OF THE INVENTION

The present invention relates to a riveting apparatus.

A riveting apparatus of that kind is known, for instance, from EP-A-0527414. Great riveting forces can be realized by riveting apparatus of that kind, in which the gearing is usually formed by a ball screw drive. In order to perform a riveting process, a blind rivet is inserted in a manner known per se into a mouthpiece of the riveting means. For setting the rivet, the rivet pin is drawn in the longitudinal direction into the rivet sleeve by means of the ball screw drive in the riveting means. The rivet pins then breaks. The required movement in the longitudinal direction of the rivet pin can be achieved by the ball screw drive of the riveting means. After setting the rivet, the direction of rotation of the motor is changed to put the riveting means with the ball screw drive back to its starting position. in riveting apparatus of that kind, the high energy consumption, however, proves to be disadvantageous. Since riveting apparatus of that kind are usually operated by a rechargeable battery, a low energy consumption is especially important to thereby prolong the possible operating time of the riveting apparatus.

SUMMARY OF THE INVENTION

Hence, it is the object of the invention to lower the energy consumption of a riveting apparatus of the above-mentioned kind.

The object is solved by the invention in that at least one flywheel is provided which is releasably connected to the motor shaft or a gearing shaft of the gearing via a clutch.

This solution is simple and has the advantage that, during permanent operation of riveting apparatus of that kind, the energy stored in the flywheel may be used for carrying out the riveting process. Thereby, the energy consumption can be significantly reduced. The flywheel may be used for accelerating the start of the motor after each riveting process, or to reduce power peaks during the riveting process and the voltage peaks for the motor generated thereby. This is in particular advantageous during permanent operation of the riveting apparatus. The flywheel keeps on rotating between the individual riveting processes and is decoupled from the motor shaft. At the beginning of the riveting process, the flywheel and the motor shaft are joined by means of a clutch. In this manner, the energy of the flywheel can be utilized. For the first time, the clutch enables to use a flywheel for a riveting apparatus having a ball screw drive. Since for re-transferring the riveting means after the riveting process, the engine must be operated in reverse direction with respect tot he riveting process, the flywheel may be decoupled from the motor during this period of time. The flywheel therefore keeps its direction of rotation. As an alternative, the flywheel can also be coupled in an analog manner with a gearing shaft of the gearing. Riveting apparatus which, for instance, comprise a ball screw drive, have a constant ratio of transmission between the motor shaft and the riveting means. Basically, it is also conceivable to use the invention in such riveting apparatus in which the drive is formed by a crank mechanism.

In an advantageous embodiment of the invention, a gearing with a ratio of transmission can be provided between the flywheel and the motor shaft, in a manner that the revolution speed of the flywheel is greater than the revolution speed of the motor shaft. Thereby, smaller flywheels can be arranged in the riveting apparatus at an equal flywheel effect. The undesired torque around the flywheel axle during start-up of the flywheel can also be reduced thereby.

It may be an advantage if the ratio of transmission is selected in a manner that the revolution speed of the flywheel is approximately twice as high as the revolution speed of the motor shaft.

According to an advantageous development of the invention, the clutch may be formed as a non-positive clutch, preferably as a frictional clutch.

It may be an advantage if the clutch is operable electromagnetically. A clutch of that kind can be realized in a simple manner.

As an alternative, the clutch may be formed as a positive clutch, preferably as a claw clutch. Thereby, an especially robust clutch can be realized.

In an advantageous development of the invention, a brake may be provided, by means of which the flywheel can be braked. This brake prevents an undesired long after-running of the flywheel. This brake may be operated by the operator, for instance, by a switch attached in the housing of the riveting apparatus.

It may prove to be advantageous if the flywheel can be braked by short-circuiting the drive motor. Then the brake can be realized in a simple manner by using the already existing components.

In an advantageous development of the invention, the flywheel may be coupled with the motor for re-charging a rechargeable battery of the riveting apparatus in order to operate the motor as a generator. Thereby, the power consumption of the riveting apparatus may be reduced.

An advantage may also be if two flywheels are provided, which have directions of rotation opposite one to another. Thereby, the torques generated by the flywheel can be reduced, since the two opposed flywheels substantially mutually compensate for their torques.

Moreover, it may turn out to be an advantage if a reverse gear is provided by means of which the direction of rotation of the flywheel with respect to the motor shaft can be changed. Then the flywheel may also be used for carrying out the back-stroke of the riveting device.

Moreover, the invention claims a method for operating a riveting apparatus, in which during the setting stroke of the riveting means, the flywheel is coupled to the motor shaft and is decoupled therefrom during the backstroke of the riveting means. Thereby, the energy consumption for setting the rivets can be significantly reduced, in particular during permanent operation.

It may turn out to be an advantage when, upon termination of the riveting process, the flywheel is coupled to the motor shaft of the drive motor to operate the drive motor as a generator. Thereby, the current generated by the generator may, for instance, be supplied to a rechargeable battery to enable an extended work period by means of the rechargeable battery.

The invention will now be described in detail by means of two embodiments.

DETAILED DESCRIPTION OF THE DRAWINGS

Figure 1:
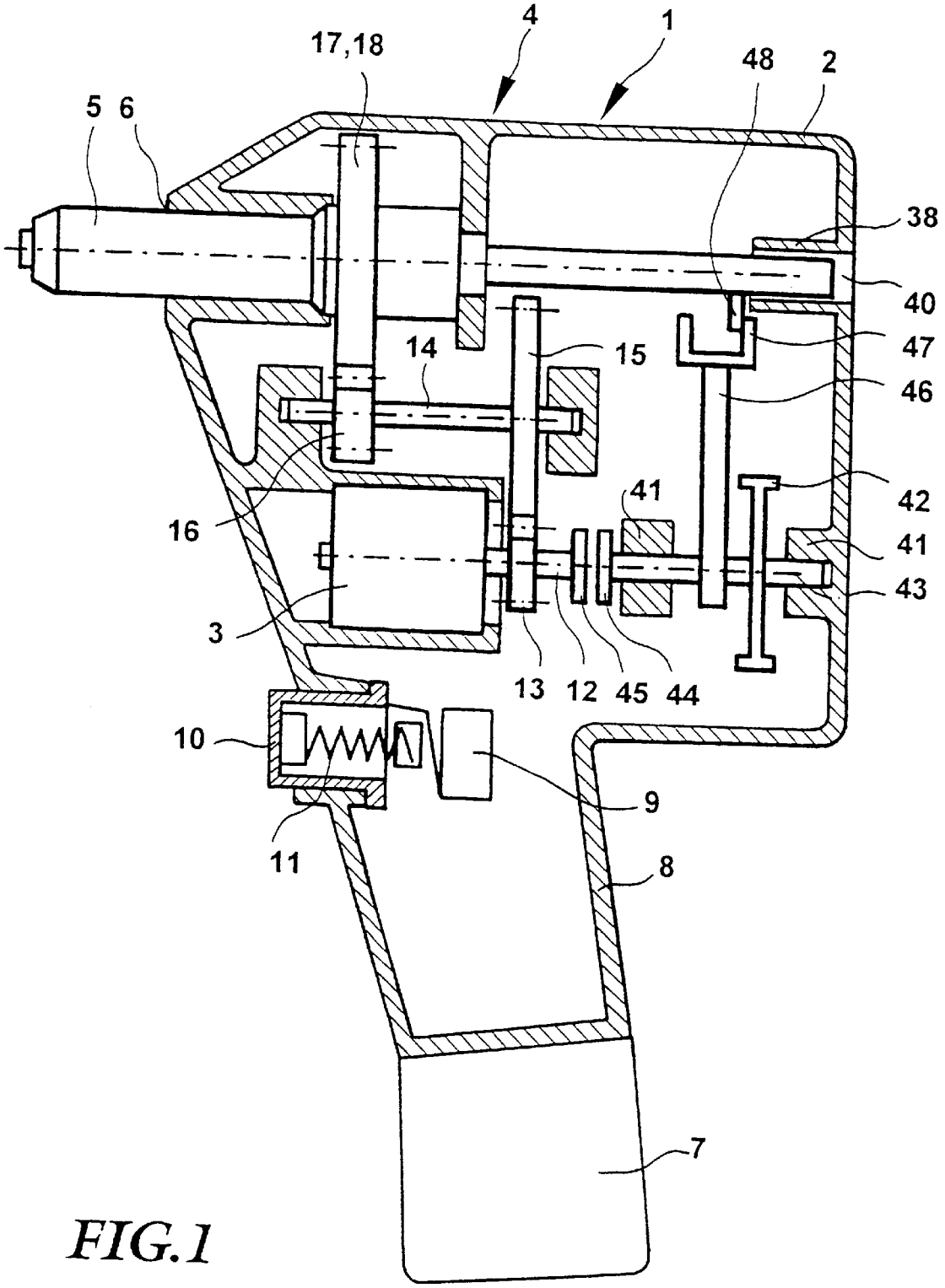
FIG. 1 shows a first embodiment of the riveting apparatus according to the invention.

FIG. 1 shows a first embodiment of the riveting apparatus 1 in a sectional view. The riveting apparatus 1 comprises a housing 2 in which a drive motor 3, a gearing 4 and a riveting device 5 are arranged. The riveting device 5 opens through an opening 6 of the housing 2 towards the outside.

Moreover, a removable power supply unit 7 is attached in a manner known per se at the housing. The power supply unit 7 is attached underneath a housing portion, with said power supply unit being formed as a handle 8. The power supply unit 7 comprises rechargeable batteries, which are not shown, which supply the drive motor 3 with current via electric contact and lines that are not shown.

A switch 9 is provided between the drive motor 3 and the power supply unit 7, said switch being operable via an operating means 10 formed as a pushbutton. The operating means 10 is slidably displaceably accommodated in the handle 8 of the housing 2. By pressing the operating means 10 into the housing 2 by using a finger of the hand of an operator, the switch 9 may be operated in a manner that the drive motor 3 is connected to the power supply unit 7 to operate the drive motor 3. The respective wiring is not shown for reasons of clarity; it is, however, made in the usual manner.

The operating means 10 is loaded by a spring 11, so that it is forced back into its starting position when releasing the operating means 10 and the switch 9 is interrupted. Thereby, the power supply to the drive motor is interrupted in a manner known per se.

The drive motor 3 is a conventional electromotor, which comprises a motor shaft 12. A pinion 13 is fixed for co-rotation on the motor shaft 12.

The gearing 4 consists of a gearing shaft 14 rotatably supported in the housing 2, and which is provided with a spur wheel 15 and a pinion 16, both being fixed for co-rotation on the gearing shaft 14. The spur gear 15 is in engagement with the pinion 13, whereas the pinion 16 is in engagement with a gearing 17 of the riveting device 5.

Figure 3:
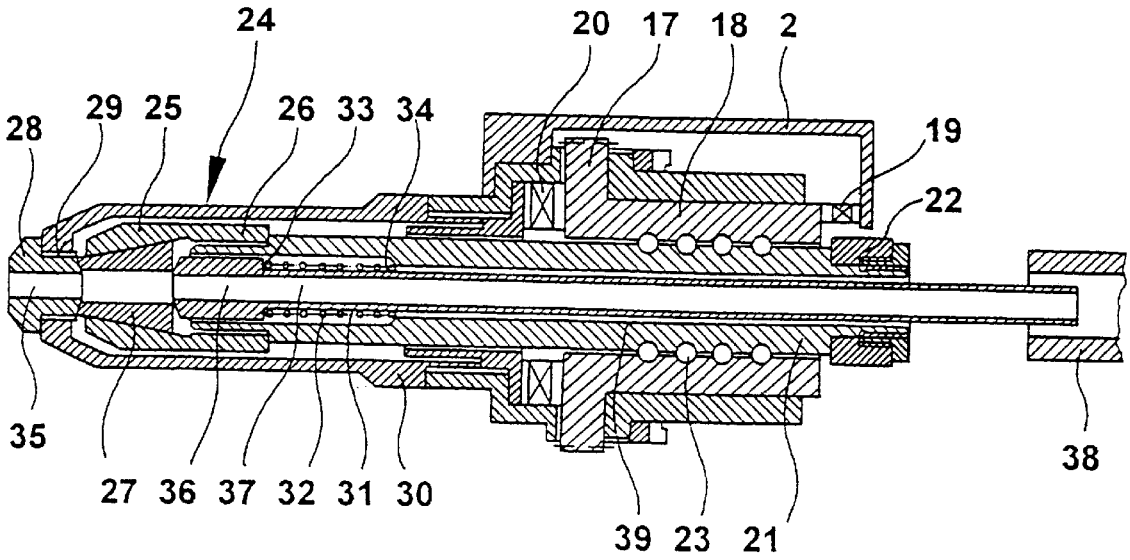
FIG. 3 shows a riveting device in a sectional view.

The riveting device 5 is shown in FIG. 3 in a sectional view.

The toothing 17 is part of a ball screw nut 18. The ball screw nut 18 is supported in the axial direction by two pressure bearings 19 and 20. The ball screw nut 18 rotates on a spindle 21. The spindle 21 is supported through a torque support 22 at the housing in a manner to prevent rotation.

Balls 23 are arranged between the spindle 21 and the ball screw nut 18. An axial movement of the spindle 21 is performed by turning the ball screw nut 18. An end of the riveting device 5 is provided with a tensioning device 24 for receiving the blind rivets. The tensioning device 24 is composed of a chuck housing 25 screwed onto the spindle 21 by means of a thread 26. The interior of the chuck housing converges conically. Clamping jaws 27 are arranged within the chuck housing 25, said clamping jaws also being formed conically. The inner faces 28 of the clamping jaws extend in parallel to one another. The clamping jaws 27 slightly project over the chuck housing 25 and are supported at a mouthpiece 28, which is attached through a thread 29 at a housing portion 30 of the riveting device 5. A sleeve 31 is arranged on the side of the clamping jaws 27 opposite the mouthpiece 28, said sleeve being loaded by means of a spring 32 in a direction towards the mouthpiece 28. The sleeve 31 is supported at the clamping jaws 27. The spring 32 is supported at a support face 33 of the sleeve 31 and a support face 34 of the spindle 21.

The mouthpiece 28 has a through bore 35 and the sleeve has a through bore 36. The through bore 35 and 36 form a channel 37 jointly with the clamping jaws 27.

The sleeve opens into a tube 38 at the end of the sleeve 31 opposite the mouthpiece, said tube being attached at the housing 2. The sleeve 31 is guided in a telescopic manner within the tube 38. The sleeve 31 is received in an axially displaceable manner in a through bore 39 of the spindle. The sleeve 31 is supported displaceably in the axial direction. The tube 38 opens into an opening 40 through which the rivet pins may fall from the sleeve 31 to the outside after the riveting process.

Moreover, a flywheel 42 is rotatably supported in the housing 2 in two support locations 41. The flywheel 42 has an axle 43. A coupling disk 44 is fixed for co-rotation on one side of the axle. The drive motor 3 has another matching coupling disk 45 on its motor shaft 12. The coupling disk 45 with the motor shaft 12 and the drive motor 3 are fixed in the axial direction.

The flywheel 42 with the coupling disk 44 and the axle 43 are displaceable in the axial direction. A coupling shifter 46 is fixed in the axial direction on the axle 43. By axially displacing the axle 43, the coupling shifter is therefore also moved. The coupling shifter has a fork 47 on its upper end, within which a shift pin 48 is arranged. The shift pin 48 is fixedly connected to the sleeve 31. During the riveting process, the shift pin 48 moves jointly with the sleeve 31 from the left to the right in FIG. 1. After traversing a clearance determined by the shape of the fork, the shift pin 38 engages the fork 47 and moves the axle 43 along with the flywheel 42 and the coupling disk 44 also to the right, so that the coupling disks 44 and 45 are disengaged. Thereby, the flywheel is decoupled from the motor. When re-transferring the riveting device 5 into the starting position, the fork 47 and the shift pin 48 are disengaged again. Then the axis of rotation 43 is axially displaceable again in the direction towards the drive motor. The coupling disks 44 and 45 can be engaged again by a means that is not shown, when the riveting device 5 is in the starting position and a new setting process is to be started.

The coupling disks may, for instance, be formed as a frictional clutch. Alternatively, they may also be formed as a claw coupling, which has the advantage that axial forces do not have to be applied. As an alternative, the flywheel 42 with the associated coupling disk 44 may be transferred by means of an electromagnetic device that is not shown, from a decoupled position, in which the two coupling disks 44 and 45 are spaced apart, into a coupled position, in which the two coupling disks 44 and 45 contact each other. The electromagnetic device, that is not shown, loads the flywheel 42 and the coupling disk 44 by an axial force in the direction towards the second coupling disk 45 so that a frictional engagement between the coupling disks 44 and 45 is generated. This causes the generation of a frictional connection between the motor shaft 12 and the flywheel 42.

By means of a control, which is not shown, the flywheel may be coupled and decoupled as often as required. In the alternative embodiment of the invention, the control operates the electromagnetic device for axial displacing the flywheel 42 with the coupling disk 44 in a manner that, when setting a rivet, the flywheel is coupled to the motor shaft and when re-transferring the ball screw nut 18 into the starting position, the flywheel and the motor shaft are decoupled.

The effect and function of the invention will now be described in detail:

An operator who intends to set a rivet by means of the rivet apparatus, takes this apparatus by the handle 8. By operating the operating device 10 by using a finger, the power supply unit will be connected to the electromotor so that the apparatus starts operating.

In order to set a rivet, this rivet is first of all set into the mouthpiece 28 of the riveting device 5. The rivet pin of the rivet projects into the channel 37 until being encompassed by the clamping jaws 27.

If the riveting apparatus is put into operation, the speed of the motor shaft is transmitted by the pinion 13, the spur gear 15, the pinion 16, the gearing shaft 14 and the toothing 17, and is transferred onto the ball screw nut 18. The movement of rotation of the ball screw nut 18 is transferred into an axial movement of the spindle 21, with the spindle 21 for setting the rivet being spaced apart from the mouthpiece 28. Thereby the clamping jaws 27 are engaged with the rivet pin. Due to the conical design of the clamping jaws, the rivet pin is fixedly clamped. By moving the spindle 21, the rivet pin is drawn, with the rivet expanding in a manner known per se. At a predetermined tensile force or a predetermined path of the spindle 21, the pin is torn off in a manner known per se. The motor may be stopped in different manners. Either a detection of the maximum tensile force may take place, or the drive motor 3 can be simply turned off after a predetermined path of the tensile spindle.

After tearing-off of the rivet pin, the riveting apparatus may be removed from the set rivet. Next, the ball screw nut 18 must be re-transferred to its starting position. For this aim, the direction of rotation of the drive motor 3 is changed so that the rotation of the drive motor is translated through the ball screw nut 18 in an axial movement of the spindle now in the opposite direction. If the spindle is in its starting position again, shown in FIG. 3, the motor is turned off.

According to the invention, it is provided that during setting the rivet, i.e., when the spindle 21 is spaced apart from the mouthpiece 28, the coupling disks 44 and 45 are engaged with one another so that the flywheel 42 is coupled to the motor shaft 12. If a rivet was placed previously, the torque stored in the flywheel may be utilized to exert the appropriate riveting force. As soon as the spindle 21 after setting the rivet has reached its final position and the drive motor 3 is turned off, the flywheel 42 is at the same time decoupled from the motor shaft 12 so that it may freely run again. Now the direction of rotation of the motor may be changed to re-transfer the spindle 21 into its starting position without the flywheel 42 disturbing this change in direction of rotation.

If a further rivet is to be set, again this rivet is set into the mouthpiece 28 and the motor is put into operation. The stored torque of the flywheel can now be utilized.

The flywheel is in particular advantageous when a great number of rivets are to be set. This is in particular the case in the manufacture or installation of, for instance, car chassis. In this case, large amounts of rivets are set in a short period of time, so that the total energy consumption is severely reduced.

This is, in particular, meaningful for riveting apparatus which are operated by rechargeable batteries. Especially there is a low energy consumption important.

Figure 2:
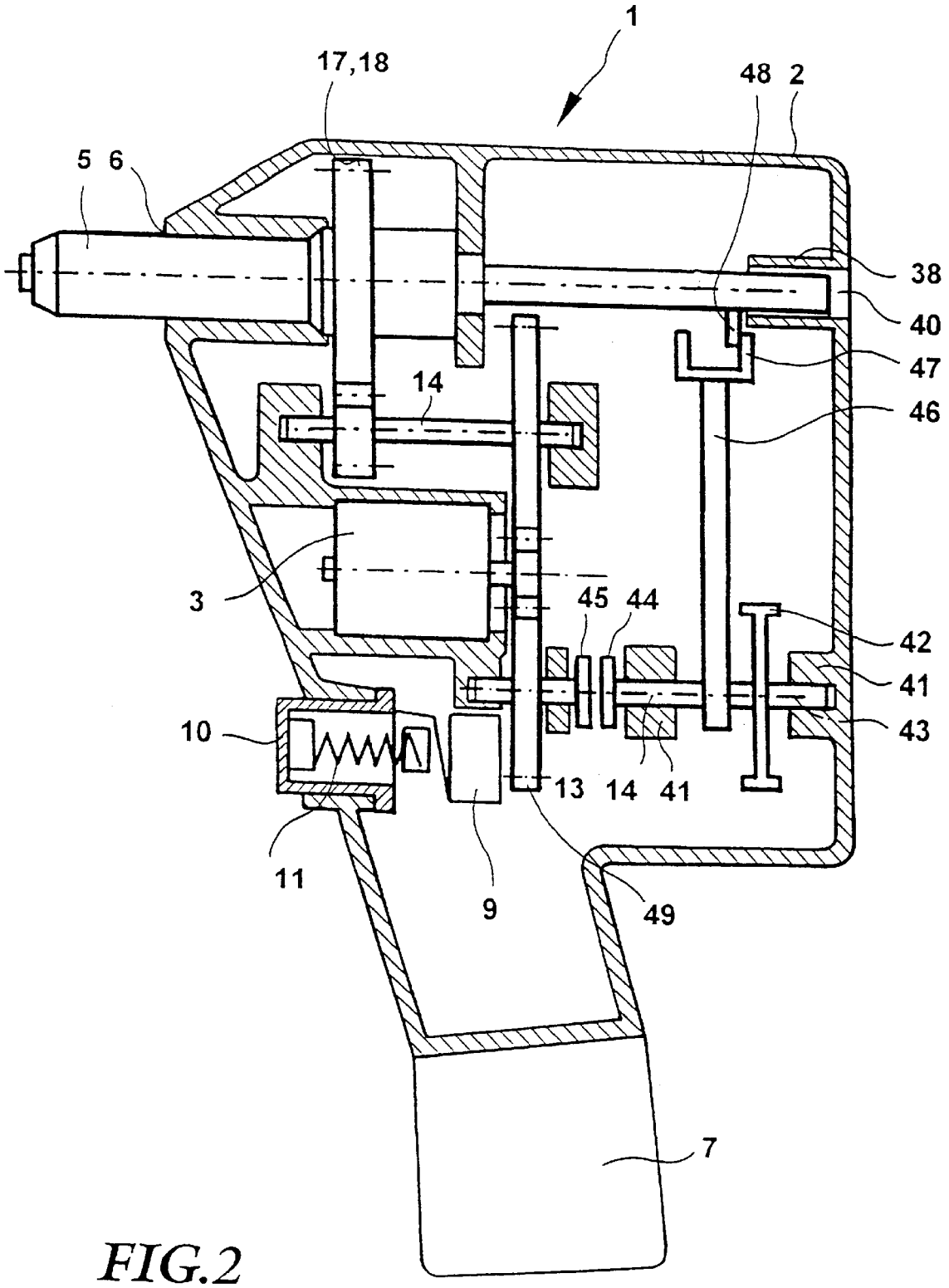
FIG. 2 shows a second embodiment of the riveting apparatus according to the invention.

The second embodiment of the invention is shown in FIG. 2. Since the essential components correspond to those of the first embodiment, only the differences to the first embodiment are described. In the second embodiment, a transmission gearing 49 is additionally provided by means of which the revoluation speed of the axle 43 is increased, preferably doubled, with respect to that of the motor shaft 12. Thereby, much energy may be stored using a comparatively small flywheel.

It is to be understood that while the invention has been described above in conjunction with preferred specific embodiments, the description and examples are intended to illustrate and not limit the scope of the invention, which is defined by the scope of the appended claims.

What is claimed is:

1. A riveting apparatus, comprising an electrically operated drive motor having a motor shaft, with a riveting device and a gearing having a gearing shaft between the drive motor and the riveting device, which transfers the rotational movement of the drive shaft into a linear movement for driving the riveting device, wherein at least one flywheel is provided, which is releasably coupled with the motor shaft or with the gearing shaft of the gearing.

2. The riveting apparatus according to claim 1, wherein a transmission is provided between the flywheel and the motor shaft, the transmission having a gearing ratio in a manner that a rotational speed of the flywheel is greater than a rotational speed of the motor shaft.

3. The riveting apparatus according to claim 2, wherein the gearing ratio is chosen in a manner that the rotational speed of the flywheel is approximately twice as high as the rotational speed of the motor shaft.

4. The riveting apparatus as claimed in claim 1, wherein the coupling is formed as a frictional coupling.

5. The riveting apparatus as claimed in claim 1, where the coupling is operable electromagnetically.

6. The riveting apparatus as claimed in claim 1, wherein the coupling is formed as a claw coupling.

7. The riveting apparatus as claimed in claim 1, wherein a brake is provided by means of which the flywheel can be braked.

8. The riveting apparatus as claimed in claim 1, wherein the flywheel is braked by short-circuiting the drive motor.

9. The riveting apparatus as claimed in claim 1, wherein the flywheel is coupled to the motor for recharging a rechargeable battery of the riveting apparatus, in order to operate the motor as a generator.

10. The riveting apparatus as claimed in claim 1, wherein two flywheels are provided which have directions of rotation opposite one another.

11. The riveting apparatus as claimed in claim 1, wherein a reversing gear is provided by means of which the direction of rotation of a drive shaft of the flywheel can be changed.

12. A method for operating the riveting apparatus as claimed in claim 1, comprising providing a setting stroke and a backstroke, and wherein the flywheel is coupled to the motor shaft during the setting stroke, and is decoupled from the motor during the backstroke.

13. The method according to claim 12, further comprising terminating the riveting process, wherein the flywheel is coupled to the motor shaft of the drive motor upon terminating the riveting process in order to operate the drive motor as a generator.

14. A riveting apparatus, comprising an electrically operated drive motor having a motor shaft, with a riveting device and a gearing, having a gearing shaft, between the drive motor and the riveting device, which transfers the rotational movement of the drive shaft into a linear movement for driving the riveting device, wherein at least one flywheel is provided, which is coupled in a releasable manner with the motor shaft or with the gearing shaft of the gearing, wherein a transmission is provided between the flywheel and the motor shaft, the transmission having a gearing ratio in a manner that the rotational speed of the flywheel is greater than the rotational speed of the motor shaft, wherein the gearing ratio is chosen in a manner that the rotational speed of the flywheel is approximately twice as high as the rotational speed of the motor shaft, wherein the coupling is formed as a frictional coupling or as a claw coupling where the coupling is operable electromagnetically, wherein a brake is provided by means of which the flywheel can be braked, wherein the flywheel is braked by short-circuiting the drive motor, wherein the flywheel is coupled to the motor for recharging a rechargeable battery of the riveting apparatus, in order to operate the motor as a generator, wherein two flywheels are provided which have directions of rotation opposite one another, wherein a reversing gear is provided by means of which the direction of rotation of a drive shaft of the flywheel is changed, wherein the flywheel is coupled to the motor shaft during the setting process of the riveting device, and is decoupled from the motor during the backstroke of the riveting device, and wherein the flywheel is coupled to the motor shaft of the drive motor upon termination of the riveting process in order to operate the drive motor as a generator.

* * * * *